US005400613A

United States Patent [19]

O'Neal

[11] Patent Number: 5,400,613

[45] Date of Patent: Mar. 28, 1995

[54] PURGER FOR REFRIGERATION SYSTEM

[76] Inventor: Andrew O'Neal, 18517 8th Ave. NE., Seattle, Wash. 98155

[21] Appl. No.: 154,537

[22] Filed: Nov. 19, 1993

[51] Int. Cl.[6] ..... F25B 45/00

[52] U.S. Cl. ..... 62/195; 62/475

[58] Field of Search ..... 62/195, 475, 85

[56] References Cited

U.S. PATENT DOCUMENTS

| | | | |
|---|---|---|---|
| 2,577,598 | 10/1951 | Zwicki | 62/117 |
| 2,920,458 | 10/1960 | Watkins | 62/195 |
| 3,664,147 | 5/1972 | Blackmon | 62/85 |
| 4,169,356 | 10/1979 | Kingham | 62/85 |
| 4,776,175 | 10/1988 | Romijn | 62/85 |
| 5,031,410 | 7/1991 | Pizak et al. | 62/85 |
| 5,187,953 | 2/1993 | Mount | 62/195 |

FOREIGN PATENT DOCUMENTS

| | | | |
|---|---|---|---|
| 365763 | 1/1932 | United Kingdom | 62/475 |

*Primary Examiner*—John M. Sollecito

[57] ABSTRACT

A portable purging apparatus that automatically removes air and non-condensable gases from an operating refrigeration system wherein refrigerant gas condenses at a cooling coil disposed in the upper portion of a purge vessel, the condensate falling to the bottom of the vessel where a pickup tube conveys the condensate out of the vessel and to a thermal expansion valve that meters refrigerant into the cooling coil, the outlet of the coil connecting to the suction line of the operating refrigeration system. Non-condensable gases collect in the top of the purge vessel and displace condensable gas around the cooling coil causing less heat load at the coil and a lower suction line temperature whereby a thermostat actuates a purging solenoid valve to discharge non-condensable gases from the purge vessel through a flow restricting orfice to the atmosphere.

12 Claims, 2 Drawing Sheets

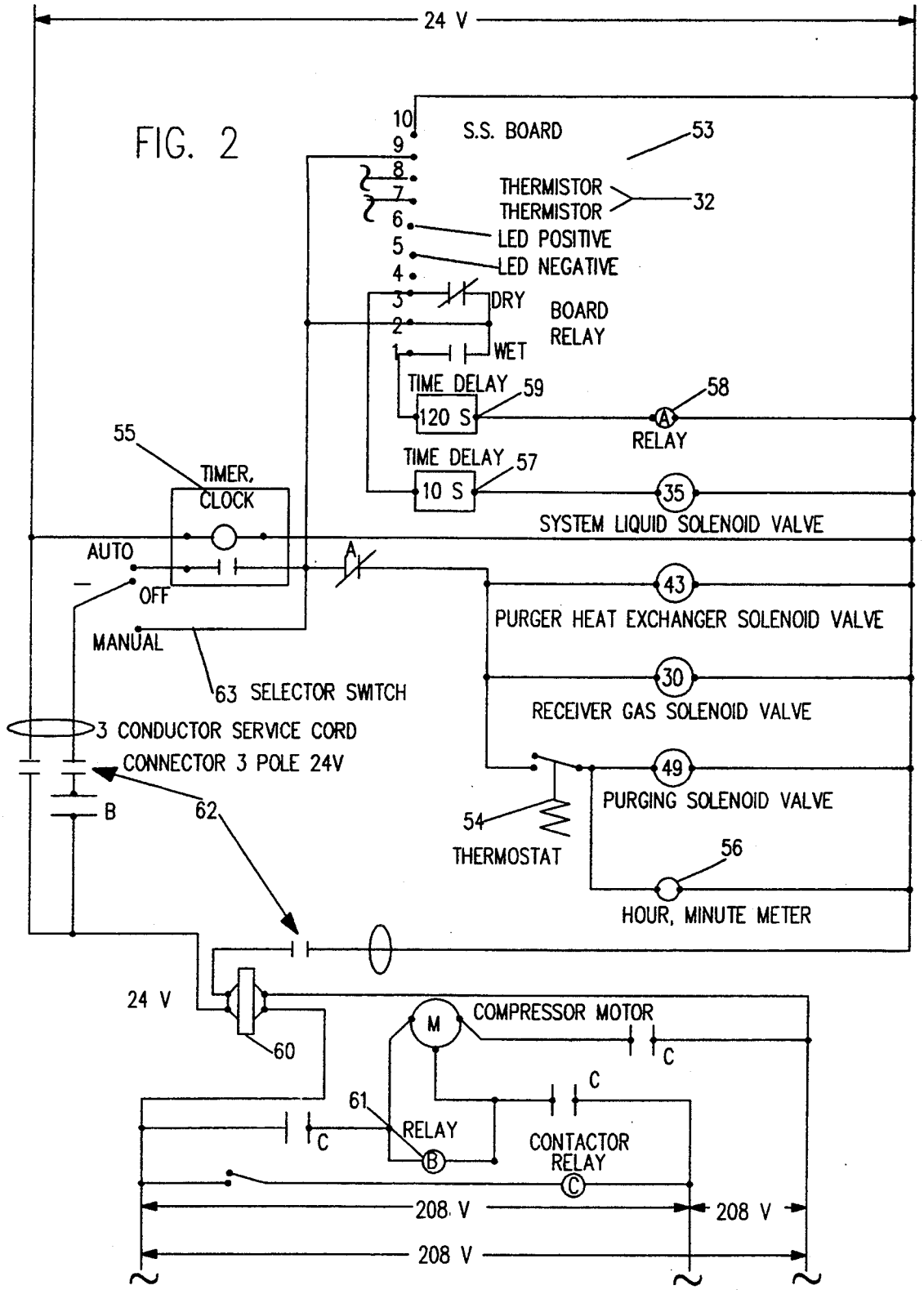
FIG. 2
24 V
S.S. BOARD
53
THERMISTOR
THERMISTOR
32
LED POSITIVE
LED NEGATIVE
DRY
WET
BOARD RELAY
TIME DELAY
59
120 S
58
RELAY
55
TIMER, CLOCK
TIME DELAY
57
10 S
35
SYSTEM LIQUID SOLENOID VALVE
AUTO
OFF
MANUAL
43
PURGER HEAT EXCHANGER SOLENOID VALVE
63 SELECTOR SWITCH
30
RECEIVER GAS SOLENOID VALVE
3 CONDUCTOR SERVICE CORD
CONNECTOR 3 POLE 24V
49
PURGING SOLENOID VALVE
B
62
54
THERMOSTAT
56
HOUR, MINUTE METER
24 V
60
COMPRESSOR MOTOR
61
RELAY
CONTACTOR RELAY
208 V
208 V
208 V

PURGER FOR REFRIGERATION SYSTEM

TECHNICAL FIELD

The present invention relates to a purging apparatus and a method of discharging air and non-condensable gases from a refrigeration system without any appreciable loss of refrigerant to the atmosphere.

BACKGROUND OF THE INVENTION

In a refrigeration system, it is well understood that air and non-condensable gases (herein after air refers to both air and non-condensable gases) can produce high head pressures and cause the compressor to operate at higher than normal temperatures. Air can react with the refrigerant and oil at the head of the compressor and cause decomposition and the formation of acids (hydrofluoric and hydrocloric). Air can be trapped in the upper space of the receiver or can circulate through the system, induced by the velocity of the refrigerant. In the evaporator or the condenser, air can interfere with the heat exchange process.

Air can be present in a system because of incomplete evacuation after pressure testing with nitrogen, by leakage of air into a system that operates under a vacuum and by the seepage of air into the system when opened for the repair or replacement of a component. In most cases, the customary method of removing air is to manual purge at the location where the system was opened or to pump down the system, shut off the compressor and manual purge from the top of the condenser. This is wasteful as refrigerant is released with the air and contaminates the atmosphere. Therefore, it is necessary that more efficient methods of purging be used. U.S. Pat. Nos. 2,920,458 and 4,776,175 show a purging method and apparatus using a cooling means such as circulating cold water or refrigerant from a secondary refrigerating machine through a coil or jacket of a purger vessel for the purpose of condensing the refrigerant gas entering the purger. Air collects in the upper portion of the purger, displacing the contact of the condensable gas at the cooling coil causing a lowering of the temperature at the coil outlet. Pressure or temperature sensing means actuate a solenoid operated purging valve to discharge air from the purger when these lower conditions occur. These purgers must be permanently located at an elevation above the receiver to allow drainage of the condensed liquid refrigerant back through a two phase conduit to the receiver. This limits the purger to use on one system as they are piped in and the bulk and weight of the purger would make it not practical to move.

Many fluorocarbon refrigeration applications such as in supermarkets use multiple systems of single compressors or of multiple compressors connected in parallel. Typically there are from two to six or more systems in one supermarket. Therefore an efficient purger that is portable and easily hooked up is needed.

DISCLOSURE OF INVENTION

This invention is an improvement of the known methods of purging technology in that the bulk and weight of the purging apparatus is reduced substantially so it can be easily moved from one system to another and be easily hooked up. It is not necessary that the purger be located above the receiver. A secondary refrigerating machine or the circulation of a secondary cooling medium is not required. The operation of the purger is automatic. The purger is connected to the system by refrigeration duty hoses with wrench tight connectors to the liquid line, the suction line and to the purge point which is usually at the top of the receiver or to the top of the outlet header of the condenser, usually an evaporative condenser.

The purger consists of a vertical cylindrical pressure vessel having a cooling coil disposed in the upper portion of the purger. Gas and any air from the top of the receiver enters the purger and the refrigerant gas condenses at the cooling coil. Air collects in the top of the purger as air is of lower density than the refrigerant gas. Condensate from the coil drops to the bottom of the purger vessel. A pickup tube at the bottom of the vessel collects the liquid and connects to a liquid line at the exterior of the vessel. This line conveys the liquid through a electrically operated solenoid valve and a metering device such as a thermal expansion(TX) valve or capillary tube or tubes to the inlet of the cooling coil. The liquid evaporates and leaves at the outlet connection of the coil which connects to the suction line of the system. Thus the system provides the cooling at the purger so that secondary refrigerating means is not necessary. A makeup solenoid valve and liquid line supplied by the system liquid line connects at a tee at the inlet of the metering device for the purpose of start up and for makeup of liquid as required during purger operation. The makeup solenoid valve is actuated through a relay by a liquid level sensing thermistor located at the lower quadrant of the purger vessel and a solid state device.

The sizing of the cooling coil is of greater capacity than that of the TX valve when gas from the receiver is being condensed so there is high superheat at the outlet suction line of the coil. When air accumulates in the upper space of the purger and collects around the cooling coil, there is less contact of condensing gas with the cooling coil and the superheat becomes less and the temperature at the suction line becomes lower. A temperature control using a thermistor sensor at the suction line actuates a purging solenoid valve when the temperature at the suction line drops to the setpoint and air is purged through a flow restrictor to the atmosphere. As air leaves the purger, more coil surface is exposed to the condensing gas and the suction temperature rises, shutting off the purging solenoid valve.

Air can be trapped at the outlet header of the condenser and as a single purge point for the purger is desirable, a further improvement of the purging process enables this air to be conveyed through the condenser drain line to the receiver. This is accomplished by a small diameter tube or capillary tube that connects with a shutoff valve at the top of the outlet header and extends to the location of the outlet connection of the header to the condenser drain line, entering the header and extending down into the drain line so that the velocity of the liquid and gas in the drain line creates a venturi effect to induce the air in the capillary tube to be drawn into the flow of the drain line and be conveyed into the receiver where the air collects at the top of the receiver,to exit through the single point purge valve with the air in the receiver and to enter the purger vessel to be discharged to the atmosphere. The outlet header valve should be opened only just prior to and during the purger operating period so that uncondensed gas does not enter the condenser drain line.

These and other novel features of the invention will be better understood by reference to the following drawings and detailed description.

DESCRIPTION OF THE DRAWINGS

FIG. 2 is a schematic electrical diagram of the invention.

DESCRIPTION OF THE PREFERRED EMBODIMENT OF THE INVENTION

Figure 1:
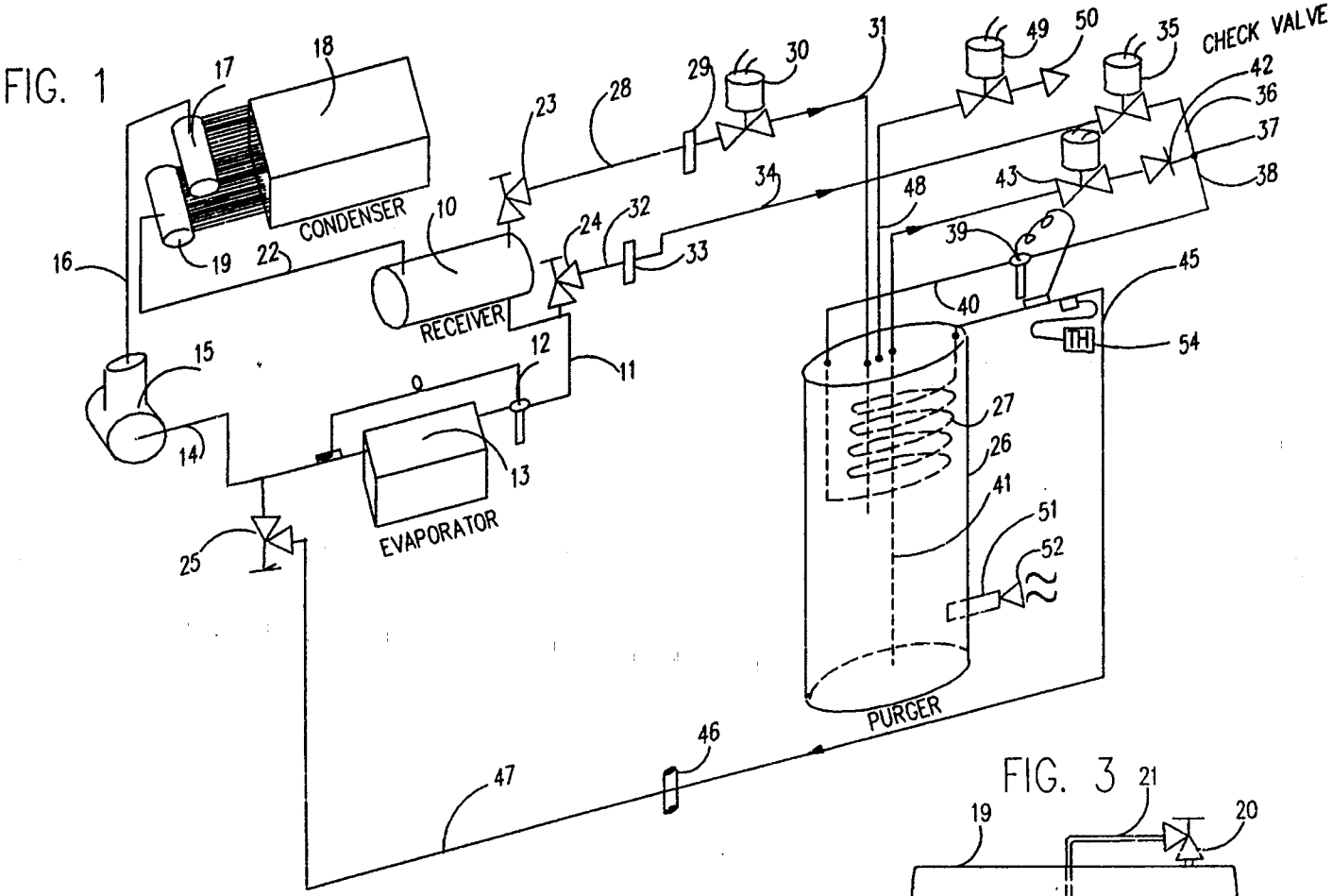
FIG. 1 is a schematic representation of the invention in reference to the description of the invention.

FIG. 1 shows the purging apparatus and the connection to a primary refrigeration system,herein after described as the "system," that requires purging of non-condensable gases and air. This system shows a single compressor and a single evaporator for clarity but the system could include multiple compressors in parallel and could include a two stage compression system. Multiple evaporators in parallel could also be included. This conventional system operates as follows. The compressor 15 receives low pressure gas in the suction line 14 and compresses it to a higher pressure and temperature where it is conveyed in the discharge line 16 to header 17 and the condenser 18 where the gas is cooled and condensed and travels by gravity to the condenser outlet header 19 and condenser drain line 22 to the receiver 10 which stores the resultant liquid refrigerant. The liquid line 11 conveys the liquid to the metering device 12, generally a thermal expansion(TX) valve that feeds liquid to evaporator 13 where evaporation produces cooling and the evaporated gas returns to the compressor to repeat the cycle.

The purging apparatus is enclosed in a sheet metal or aluminum casing, not shown, and is adaptable for easy transportation from one job site to another. The purger vessel 26 is a vertical cylindrical steel tank with closed ends having a cooling coil 27 disposed in the upper portion of the vessel. Connecting the purging apparatus to the system are three lines, to be described later, that are typically refrigeration duty hoses or alternately can be steel pipe or copper tubing if the purger is to be permanently located.

In operation, refrigerant gas and air or non-condensable gas from the top of the receiver 10 through shut off valve 23, hose 28 and connector 29 is directed by electrically operated solenoid valve 30 through line 31 to the purger vessel 26 and extends downward in the vessel about half way. This gas condenses at the cooling coil 27 and the condensate drops to the bottom of the vessel. Air, being of lower density than the refrigerant gas, collects at the upper portion of the vessel. The condensate collects in the bottom of the vessel and is conveyed as a liquid in line 41 out of the vessel and to solenoid valve 43 and check valve 42 which prevents back flow and to junction tee 37 and line 38 to TX valve 39 which meters the refrigerant through line 40 into cooling coil 27 where evaporation produces cooling. A liquid solenoid valve 35 supplies liquid from the system liquid line through shut off valve 24, hose 32 and connector 33 and line 34 to line 36 to junction tee 37 for the purpose of providing liquid to the TX valve 39 at start up and for make up of liquid as required during the purging process. Solenoid valve 35 is controlled through a single pole double throw relay of solid state controller 53 as shown in FIG. 2 and which is activated by liquid level sensing thermistor 52 located at connector 51 at the lower quadrant of purging vessel 26. The controller 53 actuates to open the system supplied liquid solenoid valve 35 if the level of liquid in the purger vessel 26 drops below the level where the thermistor 52 is located. The outlet of the cooling coil 27 is connected by line 45, connector 46 and hose 47 to the system shut off valve 25 at the suction line 14 to system compressor 15. The thermal bulb of TX valve 39 is secured to suction line 45. If there is mostly condensable (refrigerant) gas entering the purger vessel 26, there is high conductance to the cooling coil 27 and as latent heat is involved in the condensing of gas, there will be a higher heat load than the TX valve 39 is purposely designed for and there will be high superheat at the suction line 45. As air enters the vessel and collects around the cooling coil 27, there is a shielding effect that limits the contact of the refrigerant gas with the cooling coil. As there is mostly sensible heat involved with the heat exchange with air, there will be less heat load on the cooling coil and the superheat will be less and the temperature at the outlet of of the cooling coil will be lower. As the amount of air in in the purger vessel 26 increases, the temperature at the outlet of the cooling will drop to a point where a thermostat 54, having a sensing bulb secured to cooling coil outlet 45, will close a electrical circuit to open a solenoid operated purging valve 49 in line 48 that connects to the top of the purging vessel 26 to commence purging and discharge air through a flow restricting orfice 50 to the atmosphere. As air leaves the purger vessel 26, more surface will be exposed to condensable gas and the heat load at the cooling coil 27 will increase with a corresponding increase of the superheat and temperature at the coil outlet which will cause the thermostat contacts to open and terminate the purging of air. This process will continue to the end of the purging period. If there is no air in the system, the purging valve 49 will remain closed. The purging operating period can be controlled by manually opening or closing of system shut off valves 23,24 and 25. The preferred automatic control, as shown in FIG. 2, uses a 24 hour timer 55 that is synchronized with the system timer, if one is used for initiating the defrosting of the system evaporator coil 13. The timer is typically set for one hour purging periods twice a day and so that the purger is not operating while any system evaporator is defrosting. An hour-minute meter 56 that is connected electrically in parallel with the purging solenoid valve 49 serves as an indication of the amount of air that is released from the purger vessel 26, therefore the need for purging can be determined. A solid state time delay 57 prevents short cycling of the liquid solenoid valve 35 from the system.

A relay 58 with normally closed contacts in the electrical line to solenoid valves 30, 43 and 49 serves to shut down the purger operation if liquid in the purger vessel 26 rises above the level of the liquid level sensing thermistor 52 for a determined length of time as set by solid state time delay 59 in the line to relay 58. Relay 58 is actuated by the "wet" relay contact of controller 53. Purging operation resumes automatically when the liquid level in the purger vessel falls below the level of thermistor 52.

The purger operates at 24 volt, AC from the secondary of transformer 60 that is located at the system compressor control panel and powers the timer clock continuously. The balance of the electrical functions of the purger is controlled by normally open contacts of relay 61 that is in parallel with the system compressor motor so that the purger is not operating if the compressor motor is not running. Connector 62 at the system control panel provides a connection for a three wire electrical service cord to the purger apparatus.

Figure 3:
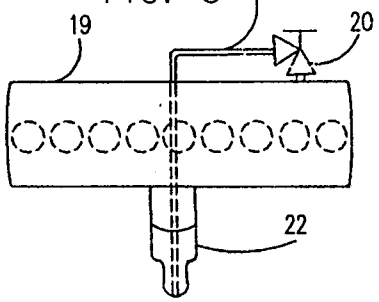
FIG. 3 is a section of the outlet header of the system condenser showing the detail of the shut off valve and the small diameter tube that enters the condenser drain line.

FIG. 3 shows a detail of the elevation of the condenser outlet header 19 where air can be trapped in the upper space there. This air is removed through a small diameter tube 21 from shut off valve 20 at the top of the outlet header and through the outlet header into the condenser drain line 22 and induced into the flow of the liquid and gas into the system receiver 10. The valve would be manually opened prior to and during the purging period. This provides single point purging from the top of the receiver.

For clarity, various components normally used on refrigeration and purging system such as but not limited to driers, sight glasses, pressure gauges and digital temperature displays are not shown but this does not intend that they not be used. Other changes and modifications will be apparent to those of ordinary skill in the refrigeration arts and are included within the scope of this invention as defined in the claims set forth below.

I claim:

1. A purging apparatus for purging non-condensable gas from a operating closed loop refrigeration system comprising a compressor, discharge line, condenser, condenser drain line, receiver, liquid line, metering device, evaporator and suction line to the compressor, said purging apparatus including means for transferring refrigerant gas and non-condensable gas from the top of said system receiver through a first electrically operatable valve to a vertical enclosed cylindrical vessel, said vessel having a cooling coil disposed in the upper portion of the vessel for the purpose of condensing said refrigerant gas, the condensate thereof falling to the bottom of said vessel, piping is provided with a second operatable valve and is disposed at the bottom of said vessel to convey said condensate out of the vessel and through said second electrically operatable valve to a metering device, said metering device connects to the inlet of said cooling coil providing evaporation and cooling in the coil whereby the outlet of the cooling coil connects with the system suction line, the non-condensable gas enters the purger vessel from the said system receiver and, being of lower density than the refrigerant gas, collects at the top of the vessel and displaces the refrigerant gas at the cooling coil thereby causing a loss of refrigerating load and subsequently less superheat and a lower temperature at the outlet of the cooling coil, a thermostat with a sensing bulb is provided at the cooling coil outlet, said thermostat comprises means to close a contact when the temperature falls to a predetermined setpoint thereby energizing a third electrically operatable valve connected by a line to the top of the purger vessel for discharging non-condensable gases through a flow restricting orfice to the atmosphere, said thermostat de-energizes said third electrically operatable valve at a predetermined rise of the temperature at the coil outlet when the quantity of non-condensable gas in the said purger is reduced; said refrigeration system condenser having an inlet header and an outlet header, said outlet header is provided with means for passing non-condensable gases trapped in an upper portion of said outlet header through a shut off valve and a small diameter tube, said tube extending from said upper portion of said outlet header to a location above said condenser drain line which connects and extends downward from the said outlet header, said tube extending downward into the condenser drain thereby defining means for bleeding said non-condensable gas into the flow of liquid and gaseous refrigerant into said receiver.

2. A purging apparatus as defined in claim 1, wherein a line is included to transfer liquid refrigerant from the system liquid line through a fourth electrically operatable valve to a three way junction at the inlet to the said metering device for the purpose of providing liquid to the said cooling coil for the purger on start up and to provide makeup of liquid from the said system liquid line as required during the purger operating period and a check valve down stream from the said second electrically operatable valve preventing back flow through the said second valve when liquid is being supplied from the said system liquid line.

3. A purging apparatus as defined in claim 2, wherein further control of purging functions is through a solid state controller having sensing means of a liquid level sensing thermistor in contact with the refrigerant at the lower quadrant of said purger vessel to activate by changes in resistance of said thermistor through said solid state controller, a single pole—double throw relay of the controller to make one circuit to energize said fourth electrially operatable valve when the liquid level in the said purger vessel is below said thermistor and the opposite position of said relay, when the level of refrigerant is at or above said thermistor, energizes a second relay in series with a solid state time delay relay that after a determined time, opens the electrical circuit to said electrically operatable first, second and third valves, effectively shutting down the purging process if an excess of liquid refrigerant is in the said purger vessel, the purging process continuing if the liquid level drops below said thermistor.

4. A purging apparatus as defined in claim 3, wherein a selector switch provides for manual control of the purging period or alternately provides for automatic control through a twenty four hour timer to schedule desirable purging periods.

5. A purging apparatus as defined in claim 3, wherein a hour meter is connected electrically in parallel with said third electrically operatable valve to record the elapsed time of purging to the atmosphere.

6. A purging apparatus as defined in claim 3, wherein a electrical transformer with a 24 Volt secondary is located at the system compressor control panel and a system relay, electrically in parallel with the system compressor motor, opens the 24 Volt circuit to the purging apparatus if the compressor motor is not in operation and a 3 pole, 24 Volt electrical connector at the system compressor panel provides a connection by a three wire electrical service cord to the purger apparatus.

7. A purging apparatus as defined in claim 1, wherein the said metering device is a thermal expansion valve.

8. A purging apparatus as defined in claim 2, wherein said connection means to said system receiver, liquid line and suction line includes system shut off valves and the said connecting lines to the said purging apparatus includes refrigerant duty hoses with wrench tight fittings, said hoses with inclusive valves opposite the system shut off valves.

9. A purging apparatus as defined in claim 1, wherein said condenser is an air cooled condenser.

10. A purging apparatus as defined in claim 1, wherein said condenser is an evaporative condenser.

11. A purging apparatus as defined in claim 3, wherein said sensing means of liquid level is by a optically detected solid state opto-electric module.

12. A purging apparatus as defined in claim 1 wherein the said metering device is sized so that when primarily refrigerant gas is being condensed at the said cooling coil, the superheat and temperature at the outlet of the cooling coil will be comparatively very high and that when air progressively replaces refrigerant gas at the cooling coil, the superheat and temperature at the outlet of the cooling coil will become progressively lower whereby at a determined temperature, the said thermostat will actuate the said third electrically operatable valve thusly discharging non-condensable gas through said orfice to the atmosphere, said thermostat interrupting the circuit to said valve when air leaves the space around the cooling coil and is replaced by refrigerant gas.

* * * * *